United States Patent [19]

Ross

[11] Patent Number: 4,662,476

[45] Date of Patent: May 5, 1987

[54] PORTABLE SCAFFOLD AND RETROFIT KIT THEREFOR

[76] Inventor: Thomas F. Ross, Rte. 1, Box 100, Callao, Mo. 63534

[21] Appl. No.: 819,872

[22] Filed: Jan. 16, 1986

[51] Int. Cl.[4] ..... E04G 1/24

[52] U.S. Cl. ..... 182/13; 182/16; 182/63; 180/2.1; 180/13

[58] Field of Search ..... 182/16, 13, 12, 63; 180/13, 12, 11, 2.1

[56] References Cited

U.S. PATENT DOCUMENTS

| | | | |
|---|---|---|---|
| 2,573,575 | 10/1951 | Keroson | 182/16 |
| 3,256,954 | 6/1966 | Warthen | 182/13 |
| 3,387,681 | 6/1968 | Rabjohn | 180/13 |
| 3,429,398 | 2/1969 | Reynolds | 182/16 |
| 3,731,758 | 5/1973 | Hibma | 180/11 |
| 3,865,203 | 2/1975 | Hibma | 182/16 |
| 3,930,548 | 1/1976 | Wallraff | 182/13 |
| 4,053,025 | 10/1977 | Slusarenko | 182/16 |
| 4,088,202 | 5/1978 | Costello | 180/2.1 |
| 4,475,611 | 10/1984 | Fisher | 180/11 |

*Primary Examiner*—Reinaldo P. Machado

*Attorney, Agent, or Firm*—Polster, Polster and Lucchesi

[57] ABSTRACT

A retrofit kit for a portable scaffold having a relatively open frame supported for movement on a plurality of wheels and a platform for a worker disposed on the frame includes a wheel and a mount to mount the wheel to the open frame. The mount allows horizontal movement of the rotational axis of the wheel. The wheel may be steered by structure controllable from the platform to control the direction of the movement of the scaffold. A motor is provided and is operatively connected to the wheel for moving the scaffold in the direction selected by the steering means.

10 Claims, 7 Drawing Figures

PORTABLE SCAFFOLD AND RETROFIT KIT THEREFOR

BACKGROUND OF THE INVENTION

This invention relates to construction equipment, and more particularly to movable scaffolds for use in construction and the like.

Portable scaffolds are known. These scaffolds include a relatively open frame on which a platform can be disposed to allow a worker to perform his tasks elevated above the ground. Portable scaffolds are mounted generally at their corners on a plurality of wheels or casters which readily swivel as the scaffold frame is manually pushed from place to place.

These movable scaffolds suffer from several deficiencies. For one, they require that the person working on the scaffold get down from the scaffold to push the scaffold to a new location or they require the help of an additional person on the ground to move the scaffold. This is inefficient. In addition, it is sometimes awkward for a single person to push a movable scaffold from one place to another due to the size of the scaffolds.

SUMMARY OF THE INVENTION

Among the objects and features of the present invention may be noted the provision of a movable scaffold which is easily movable by a single person.

Another object of the present invention is the provision of a movable scaffold which does not require a person to remove himself from the scaffold before moving the scaffold.

An additional object of the present invention is the provision of a movable scaffold which may be operated by the worker on the platform of the scaffold.

Another object of the present invention is the provision of a retrofit kit for existing scaffolds to allow them to be moved by a single worker disposed on the platform.

Other objects and features will be in part apparent and in part pointed out hereinafter.

Briefly, a retrofit kit of the present invention is designed for a portable scaffold having a relatively open frame supported for movement on a plurality of swivel-mounted wheels or casters, and a platform for a worker disposed on the frame. The kit includes a wheel, means for mounting the wheel to the open frame, which mounting means allows swivelling of the wheel, and means connected to the mounting means and manually controllable from the platform for steering the wheel to control the direction of the movement of the scaffold. Means operatively connected to the wheel are also included for moving the scaffold in the direction selected by the steering means.

The movable scaffold of the present invention includes a relatively open frame, a platform disposed on the open frame providing the worker a place to stand and work, and a plurality of wheels disposed below the open frame and secured thereto to permit the frame and platform to be moved from place to place. Means manually controllable from the platform are provided for steering at least one of the wheels to control the direction of movement of the frame and platform. And means are carried by the scaffold for moving the frame and platform in the direction selected by the steering means.

BRIEF DESCRIPTION OF DRAWINGS

Similar reference characters indicate similar parts throughout the several views of the drawings.

DESCRIPTION OF THE PREFERRED EMBODIMENT

Figure 1:
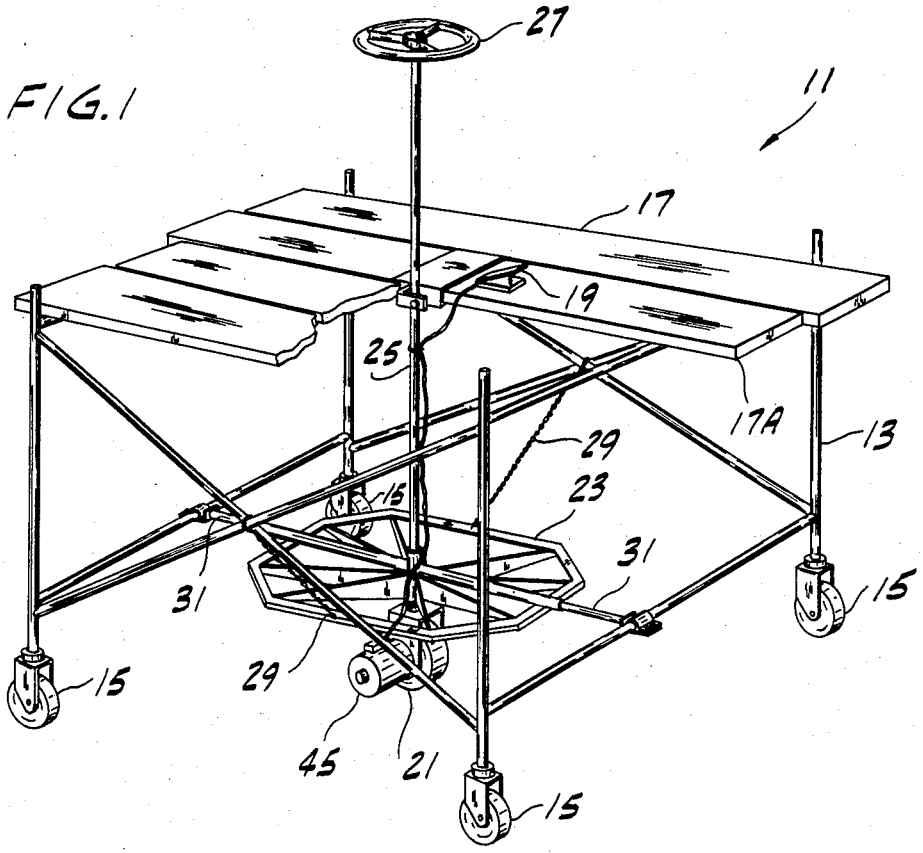
FIG. 1 is a perspective view illustrating the portable scaffold of the present invention.
Figure 2:
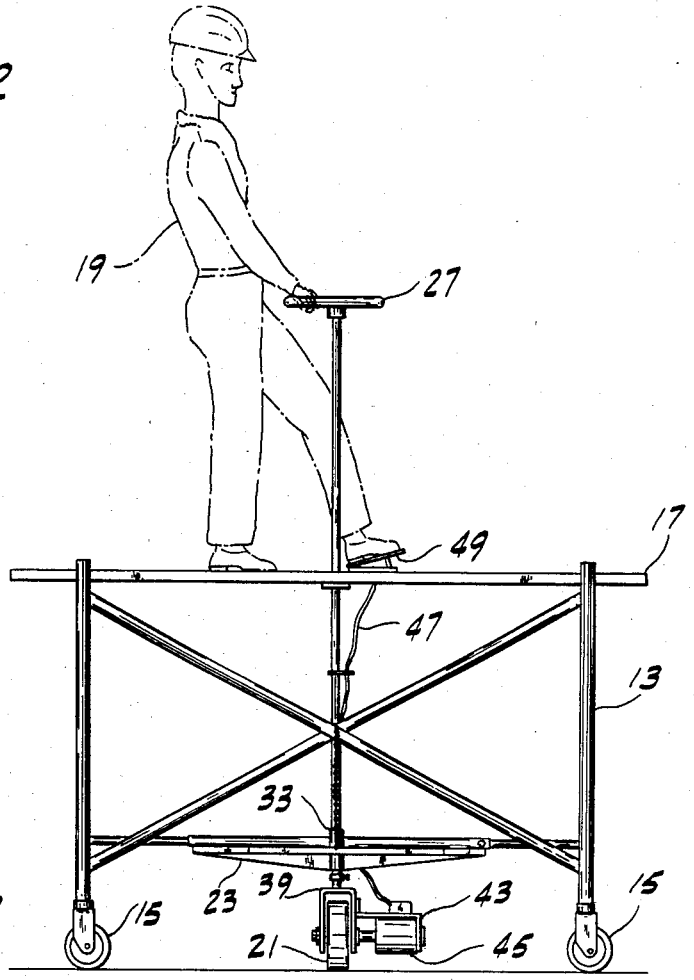
FIG. 2 is a front elevation of the portable scaffold of FIG. 1.

Turning now to the drawings, a portable scaffold 11 of the present invention is shown to include a relatively open frame 13 supported by four swivel-mounted wheels or casters 15. The open frame 13 supports a platform 17 on the top thereof, or at another desired intermediate position. Although a number of boards or planks could make up platform 17, only a single board 17A is necessary for the present invention, for reasons which will become apparent later. Platform 17 provides a place for a worker 19 (FIG. 2) to stand while he performs any of a variety of tasks such as painting, wiring, working with metal or the like. Portable scaffold 11 also includes a wheel 21 (FIG. 1) which is used to steer and drive the portable scaffold. Wheel 21 is secured in place by a base plate 23 which is secured to open frame 13. Base plate 23 is preferably centered in the relatively open frame. A shaft 25 extends from wheel 21 upwardly through base plate 23 to the platform, and more particularly to a height above the platform sufficient to allow the worker to easily rotate the shaft. A tiller 27 extends from shaft 25 to facilitate the rotation of shaft 25 by the worker about its longitudinal axis. Shaft 25 is journalled in base plate 23 so that rotation of the shaft causes corresponding rotation of the rotational axis of wheel 21. Thus, by rotation of the tiller, the worker can steer portable scaffold 11. It should be appreciated that wheels 15 are free-wheeling so that any motion imparted to the scaffold by wheel 21 will result in motion in the direction controlled by wheel 21. Base plate 23 is secured to the open frame by a pair of chains 29 and a pair of adjustable arms 31, so that the base plate may readily by levelled with respect to the frame and secured thereto.

Figure 3:
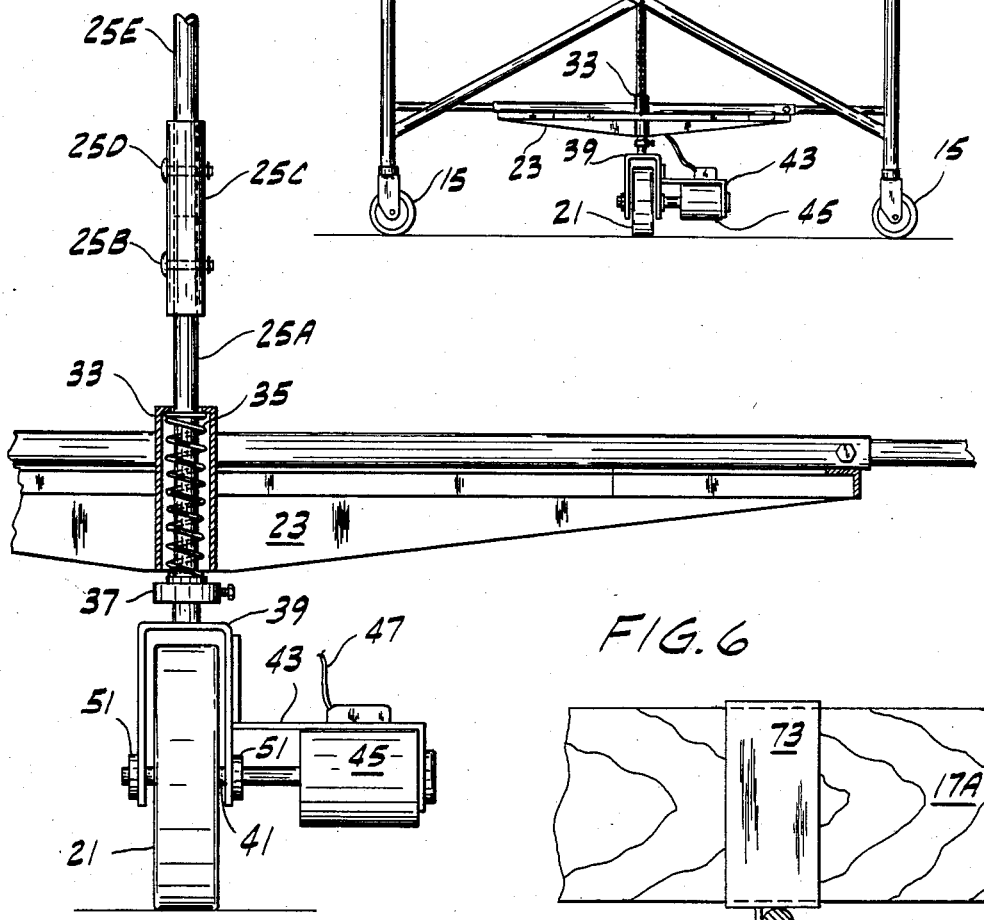
FIG. 3 is a front elevation on an elarged scale of a portion of FIG. 2.

Turning to FIG. 3, the base plate 23 is seen to have a housing 33 secured thereto and extending vertically therefrom. Housing 33 houses a spring 35 which controls the amount of pressure which wheel 21 exerts on the ground. This pressure is adjustable as described below to control the wheel bearing surface on the ground and also to provide drag against undesired movement of the wheel with respect to the ground. Spring 35 is disposed against the upper surface of housing 33 at one end and against an adjustable collar 37 at its other end. Adjustable collar 37 is secured to shaft 25 so that the tension of spring 35 forces wheel 21 downwardly.

Shaft 25 terminates at its lower end in a yoke 39. Yoke 39 has an axle 41 suitably journalled therein. Yoke 39 also has a bracket 43 secured thereto which carries a one-quarter horsepower, variable speed DC motor 45 which is directly coupled to axle 41. Preferably motor 45 is a gear reduction direct drive motor which is powered by a suitable drop-cord connected to a power source (not shown).

The speed of motor 45 is controlled by means of a cable 47 which electrically connects the motor to a foot controlled rheostat 49 disposed on platform 17. The worker can control tne speed of the scaffold between zero and a suitable top speed of, for example, five miles per hour, by pressing the foot controller down the appropriate amount. This results in the corresponding speed of rotation of motor 45 which directly drives wheel 21 to move the scaffold across the ground in the direction determined by the worker through suitable movement of tiller 27.

As shown in FIG. 3, yoke 39 has axle 41 secured thereto by suitable cotter keys or the like 51. The yoke also includes suitable bearings and washers not shown. Also shown in FIG. 3 is an alternative embodiment of shaft 25. In this embodiment, the shaft is made up of a lower portion 25A which may be suitably connected by means of a pin 25B to a coupler 25C. The coupler at its upper end may be pinned by a pin 25D to an extended shaft portion 25E of suitable length. It should be realized that by adding additional couplers 25C a steering shaft 25 of any desired length may be achieved.

Figure 4:
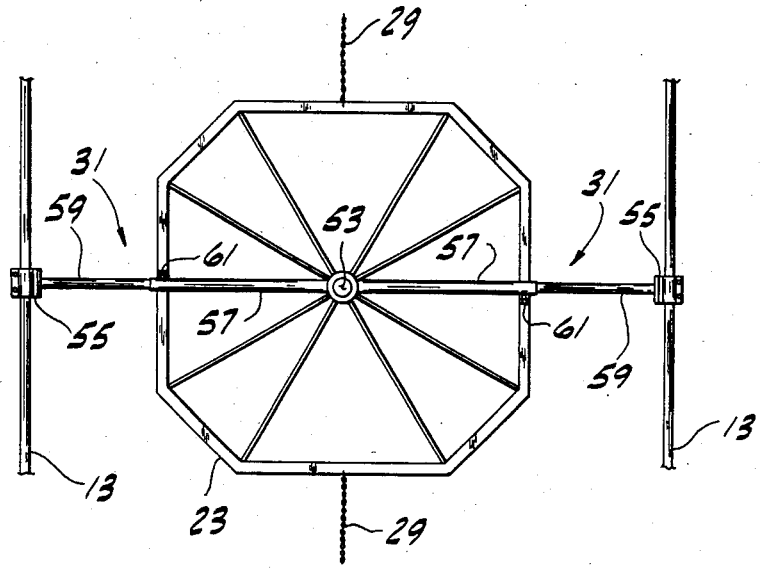
FIG. 4 is a top plan of a base plate used on the portable scaffold of FIGS. 1 and 2.
Figure 4A:
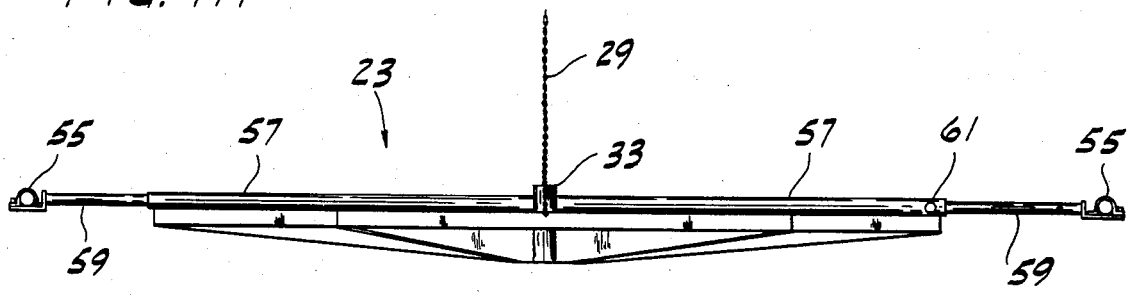
FIG. 4A is a side elevation of the base plate of FIG. 4.

One embodiment of base plate 23 is shown in FIG. 4. This base plate is relatively open and includes a central opening 53 through which shaft 25 passes. Clamps 55 are provided at each end of a pair of arms 31 extending from the central body portion of the base plate. Arms 31 are actually each composite and include an outer tube 57 in which rides an adjustable arm portion 59. The length of arms 31 may be adjusted by loosening a pair of set screws 61, moving arm portions 59 out to the desired position (which depends upon the size of the particular scaffold being used) and then retightening set screws 61. Chains 29 are also shown in FIG. 4 to extend generally from the outer perimeter of the base plate to the frame. As seen in FIG. 4A, clamps 55 are designed to accomodate the rods on each side of the relatively open frame.

Figure 5:
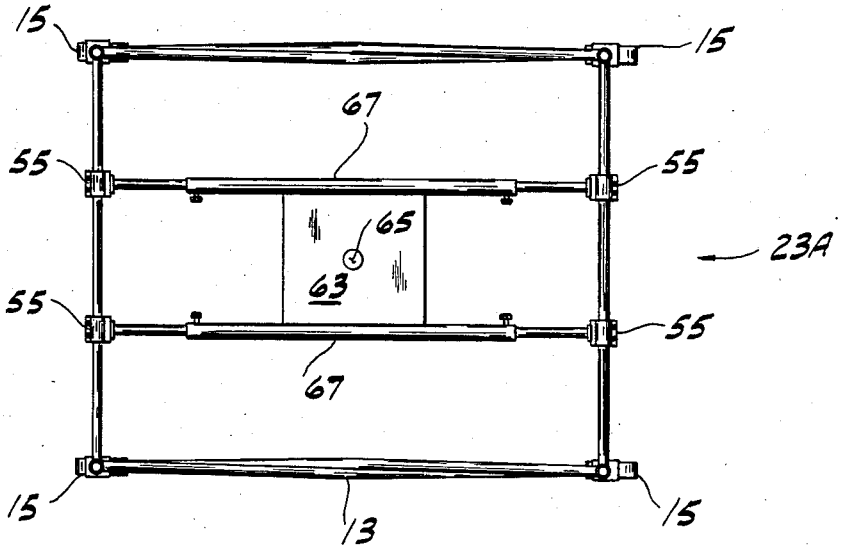
FIG. 5 is an alternative embodiment of the base plate of FIG. 4.

A second embodiment of the base plate, labeled 23A, is shown in FIG. 5. Base plate 23A includes a solid plate 63 having a central opening 65. The plate is secured by welding or the like to a pair of extensible rods 67 which extend from the centrally disposed plate to opposite sides of open frame 13 where they are secured thereto by clamps 55.

Figure 6:
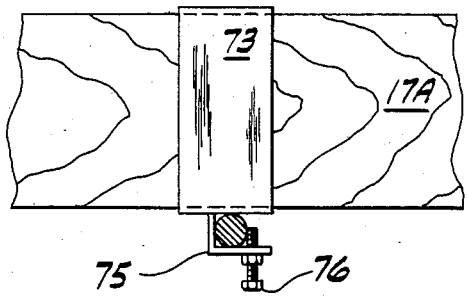
FIG. 6 is a top plan illustrating stabilizing structure of the portable scaffold.

Platform 17 (FIG. 6) includes a single plank 17A having a metal flange 73 bolted or otherwise suitably secured thereto. A generally C-shaped bracket 75 is welded to flange 73 and is shaped so as to hold shaft 25 against lateral movement. If desired, shaft 25 may be further confined in bracket 75 by a set screw 76.

It should be noted that with the adjustable arm feature of the base plate and the fact that the platform and more particularly single plank 17A is easily removed from the scaffold, the entire steering and driving members of the present invention may be readily removed from one scaffold and secured to a second scaffold. This feature also facilitates the retrofitting of current portable scaffolds with the unique features of the present invention.

In view of the above, it will be seen that the various objects and features of the invention are achieved and other advantageous results obtained.

As various changes could be made in the above constructions without departing from the scope of the invention, it is intended that all matter contained in the above description and shown in the accompanying drawing shall be interpreted as illustrative and not in a limiting sense.

What is claimed is:

1. A retrofit kit for a portable scaffold having a relatively open frame supported for movement on a plurality of wheels and a platform for a worker disposed on the frame, said kit comprising:

a wheel;

means for mounting the wheel to the open frame, said mounting means allowing horizontal movement of the rotational axis of the wheel and being adjustable to fit various sizes of frames;

means connected to the mounting means and manually controllable from the platform for steering the wheel to control the direction of movement of the scaffold; and means operatively connected to the wheel for moving the scaffold in the direction selected by the steering means;

said adjustable mounting means including a body and at least one arm extending out from the body to the side of the frame, the length of said arm from the body to the side of the frame being selectively adjustable.

2. A retrofit kit for a portable scaffold having a relatively open frame supported for movement on a plurality of wheels and a platform for a worker disposed on the frame, said kit comprising:

a wheel;

means for mounting the wheel to the open frame, said mounting means allowing horizontal movement of the rotational axis of the wheel;

means connected to the mounting means and manually controllable from the platform for steering the wheel to control the direction of movement of the scaffold; and means operatively connected to the wheel for moving the scaffold in the direction selected by the steering means;

the mounting means including a pair of adjustable arms extending outwardly from the wheel, said arms each terminating in means for securing the respective arm to the frame.

3. The retrofit kit as set forth in claim 2 wherein the mounting means further includes means for adjusting the pressure the wheel exerts on the ground and wherein the adjusting means includes a spring mounted around a shaft operatively connected to the wheel, and an adjustable collar for setting the tension of the spring.

4. A portable scaffold comprising:

a relatively open frame;

a platform disposed on the open frame providing a place to stand and work;

a plurality of wheels disposed below the open frame and secured thereto to permit the frame and platform to be moved from place to place;

means manually controllable from the platform for steering at least one of the wheels to control the direction of movement of the frame and platform; and means carried by the scaffold for moving the frame and platform in the direction selected by the steering means;

the frame including a cross-member disposed adjacent to the bottom thereof and the steering means including a shaft extending from the top of the platform generally to the one of the wheels which is steered, said cross-member having an opening therein for passage therethrough of the shaft, said cross-member thereby stabilizing the shaft.

5. The portable scaffold as set forth in claim 4 further including manually operable means for adjusting the pressure the steered wheel exerts against the ground.

6. The portable scaffold as set forth in claim 5 wherein the adjusting means includes a spring operatively mounted between the cross-member and the steered wheel to bias the wheel downwardly with respect to the cross-member.

7. The portable scaffold as set forth in claim 4 wherein the moving means includes a motor operatively connected to the steered wheel to rotate said wheel about its axis, and wherein the steered wheel is mounted for rotation in a yoke, which yoke is rotatable about an axis by the steering means to steer the steered wheel, further including a bracket extending outwardly from the yoke away from the wheel, said motor being mounted to said bracket.

8. The portable scaffold as set forth in claim 4 wherein the steered wheel is disposed below and generally aligned with the center of the open frame.

9. The portable scaffold as set forth in claim 8 wherein the steering means includes a shaft extending generally from the platform to the steered wheel, further including means for stabilizing the shaft.

10. The portable scaffold as set forth in claim 9 wherein the stabilizing means includes means adjacent the platform for confining the upper portion of the shaft against lateral movement and means adjacent the steered wheel for confining the lower portion of the shaft against lateral movement.

* * * * *